US005317341A

United States Patent [19]

Tatsumi

[11] Patent Number: 5,317,341

[45] Date of Patent: May 31, 1994

[54] THERMAL HEAD AND METHOD OF MAKING THE SAME

[75] Inventor: Yutaka Tatsumi, Kyoto, Japan

[73] Assignee: Rohm Co., Ltd., Kyoto, Japan

[21] Appl. No.: 818,381

[22] Filed: Jan. 9, 1992

[30] Foreign Application Priority Data

Jan. 24, 1991 [JP] Japan ..... 3-7257
Jan. 24, 1991 [JP] Japan ..... 3-7258

[51] Int. Cl.[5] ..... B41J 2/335
[52] U.S. Cl. ..... 346/76 PH; 29/611
[58] Field of Search ..... 346/76 PH; 29/611

[56] References Cited

FOREIGN PATENT DOCUMENTS 62-111764 5/1987 Japan .
62-124962 6/1987 Japan .
62-164556 7/1987 Japan .
62-208961 9/1987 Japan .
62-296562 12/1987 Japan .
63-049451 3/1988 Japan .
63-267564 11/1988 Japan .
1-118451 5/1989 Japan .
1-257064 10/1989 Japan .
1304960 12/1989 Japan .

*Primary Examiner*—Benjamin R. Fuller
*Assistant Examiner*—Huan Tran
*Attorney, Agent, or Firm*—Oliff & Berridge

[57] ABSTRACT

The present invention provides a thermal head capable of preventing any chipping between a glaze layer and a protective film, increasing an angle of separation in a thermal transfer ribbon and eliminating any step of abrading the protective film to prevent the separation of the thermal transfer ribbon and the darkened background of the heat-sensitive sheet, and a method of making such a thermal head.

The thermal head includes a glaze layer 12 formed as a heat-accumulating layer on a substrate 11, resistance and electrode layers 13, 14 and 15 formed on the glaze layer 12 and a protective film 16 formed to cover the entire surface of the thermal head. The edge of the glaze layer 12 is totally cut with the upper cut edge thereof being rounded. The protective film 16 is formed directly on the cut edge of the glaze layer and the substrate. After the glaze layer has been formed, the edge portion of the glaze layer 12 is cut until reaching the substrate 11. Thereafter, the glaze layer is heated at a temperature equal to or higher than its softening point to round the upper cut edge of the glaze layer. The other layers are then formed. The formed layers are then covered with the protective film 16. Finally, a portion of the protective film 16 adhered to the substrate is cut at a position adjacent to the upper rounded edge of the glaze layer.

10 Claims, 6 Drawing Sheets

THERMAL HEAD AND METHOD OF MAKING THE SAME

BACKGROUND OF THE INVENTION

1. Field of the Invention

The present invention relates to a thermal head suitable for use as a print head in various recording instruments such as printers.

2. Description of the Related Art

Conventional recording systems such as page printers, word processors, facsimiles and the like have all used thermal print heads. FIG. 3 shows a thermal head, the detail of which is further shown in FIG. 5 by fragmentary cross-section. FIG. 6(*b*) is another cross-sectional view, enlarged in scale, of the thermal head, taken along a line B—B in FIG. 5. In these figures, the edge of a substrate 1 of alumina ceramic (dielectric) is formed with a glaze layer 2 which is a heat accumulating layer. For each dot, a resistance layer 3, individual lead electrode 4, common electrode 5 and protective film 6 are formed on the substrate 1 over the glaze layer 2 in the order as just described. If a signal is selectively applied to an individual lead electrode 4 through the common electrode 5, the resistance layer 3 located between these electrodes will be heated and so cause the transfer of the ink of a thermal transfer ribbon 8 onto a recording sheet.

Such thermal heads are generally used with a resinous ink such that the thermal transfer ribbon 8 can be used to print or any recording sheet even if it has a rough printing surface. In order to prevent the resinous ink from being re-fused to the recording sheet, therefore, the thermal transfer ribbon 8 must be separated from the recording sheet as rapidly as possible after the transfer of ink has been completed. As shown in FIG. 6(*b*), thus, the chamfered edge of the conventional thermal head includes a printing portion 100 (above the resistance layer 3 between the individual electrode 4 and the common electrode 5).

More particularly, after the glaze layer 2, resistance layer 3, individual lead electrode 4, common electrode 5 and protective film 6 have been formed sequentially on the substance 1 as shown in FIG. 6(*a*), the substrate 1 will be cut by means of a diamond disc as shown in FIG. 6(*b*). Such a cutting operation comprises two separate steps, that is, one step for cutting the glaze layer 2 and protective film 6 which are of glass material by the use of a cutting edge having a fine particle size and another step for cutting the substrate 1 of alumina ceramic by the use of a cutting edge having a rough particle size.

In the conventional thermal head as shown in FIG. 6(*b*), however, so-called "chipping" may occur which results in that the protective film 6 is separated from the glaze layer 2 by an impact which is produced by the diamond cutting disc. This is because the surface of the glaze layer 2 is very smooth and makes less contact with the protective film 6 which is made of a material similar to the glass material such as tantalum pentoxide and the like. The chipping causes the moisture barrier properties to be lowered so that the common electrode 5 may become corroded, leading to various problems such as failure in conductivity amongst other things.

In order to overcome the problems, the prior art has proposed a thermal head which comprises a protecting and braking layer (7 in FIG. 6(*c*)) or a bonding layer formed outside the common electrode 5 (or at a position adjacent to the edge of the thermal head), as disclosed in Japanese Patent Laid-Open No. Sho 62-208961, 62-124962 or 63-267564. Such a layer serves to improve the adhesion between the glaze layer 2 and the protective film 6. However, the provision of the protecting and braking layer 7 as shown in FIG. 6(*c*) increases the spacing between the printing portion 100 and the cut edge portion of the thermal head such that the angle of separation $\theta$ of the thermal transfer ribbon 8 will be reduced. This makes the printed letters obscure.

If the thermal head is subjected to the cutting operation after the protective film 6 has been formed as shown in FIG. 6(*b*), the upper edge 200 of the thermal head will be formed with a very sharply angled corner. When such a sharp edge 200 is brought into contact with the thermal transfer ribbon 8 or a heat-sensitive sheet on slide movement of the thermal head, there may be created various problems such as separation of ink from the ribbon 8, darkened background of the heat-sensitive sheet and others. Thus, the upper sharp edge 200 of the thermal head or protective film 6 must be abraded to form a gentle curvature.

SUMMARY OF THE INVENTION

It is therefore an object of the present invention to provide a thermal head which can prevent the chipping between the glaze layer and the protective film and which can provide an increased angle of separation of the thermal transfer ribbon without any abrading operation for the protective film, and a method of producing such a thermal head.

Another object of the present invention is to provide a thermal head which can prevent the separation of the thermal transfer ribbon and the darkened background of the heat-sensitive sheet from being created without any abrading operation for the protective film.

To this end, the present invention provides a thermal head comprising a substrate, a glaze layer formed on the substrate to provide a heat accumulating layer, and a protective film formed over the glaze layer through resistance and electrode layers, the thermal head being characterized by the fact that the edge of the glaze layer is totally cut and that the protective film is formed directly over the cut face of the glaze layer and the substrate.

The present invention also provides a method of making a thermal head, characterized by the steps of forming a glaze layer on a substrate to provide a heat accumulating layer, cutting the glaze layer at its edge until reaching the substrate, forming a resistance layer and an electrode layer for applying the electric current to the resistance layer therethrough, forming a protective film over the entire surface of the electrode layer and finally cutting a portion of the protective film adhering to the substrate at a position adjacent to the edge of the glaze layer.

Since the protective film is formed directly on the substrate having its relatively rough surface, the adhesion between the protective film and the substrate can be improved.

Further, the chipping between the glaze layer and the protective film can be highly reduced since the glaze layer is cut at the step of forming the glaze layer on the substrate.

In still another aspect of the present invention, it provides a thermal head comprising a substrate, a glaze layer formed on the substrate to provide a heat accumulating layer, and a protective film formed over the glaze layer through resistance and electrode layers, the thermal head being characterized by that the upper edge of the glaze layer is cut and rounded.

In a further aspect of the present invention, it provides a method of making a thermal head, characterized by the steps of forming a glaze layer on a substrate to provide a heat accumulating layer, cutting the glaze layer at its edge, heating the glaze layer to a temperature equal to or higher than its softening point to provide the upper rounded edge of the cut glaze layer portion, forming a resistance layer and an electrode layer for applying the electric current to the resistance layer therethrough, forming a protective film over the entire surface of the electrode layer and finally cutting a portion of the protective film adhering to the substrate at a position adjacent to the edge of the glaze layer.

In accordance with the method of the present invention, the glaze layer is cut and rounded at its upper cut edge to have a given curvature, for example, by heating the glaze layer to its softening point. When the protective film is further formed on the substrate, a further increased curvature will be formed on the upper edge of the glaze layer.

DETAILED DESCRIPTION OF THE PREFERRED EMBODIMENTS

Figure 1A:
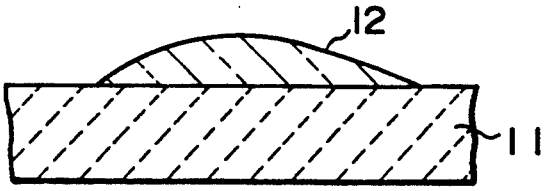
FIG. 1 is a view illustrating various steps of making a thermal head in accordance with the present invention.
Figure 1B:
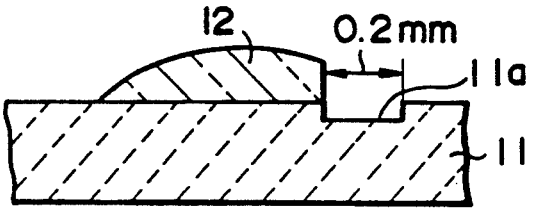
Figure 1C:
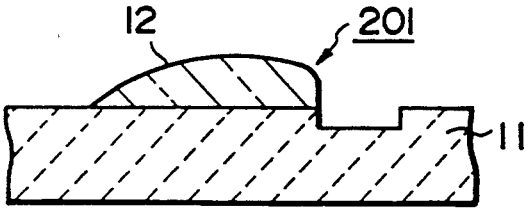
Figure 1D:
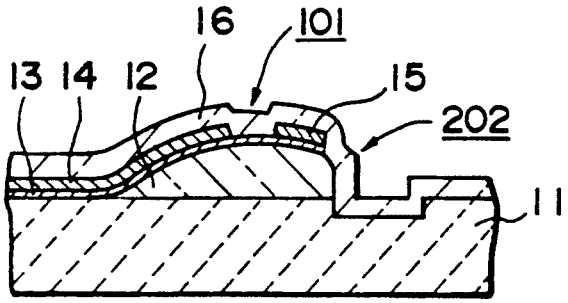
Figure 1E:
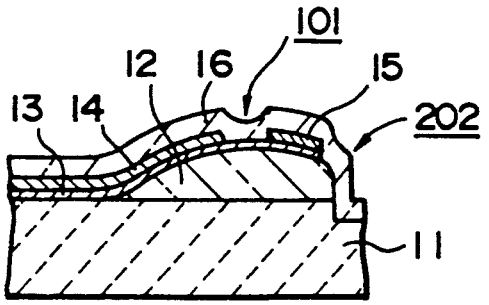

Referring first to FIG. 1, there is shown a process of making a thermal head in accordance with the principle of the present invention. FIG. 1(*a*) shows a glaze layer forming step in which a glaze layer 12 of $SiO_2$ is partially printed on a substrate 11 of alumina ceramic which is a dielectric material. The glaze layer 12 serves as a heat accumulating layer. FIG. 1(*b*) shows a first cutting step carried out after completion of the glaze layer forming step. In the first cutting step, the glaze layer 12 is cut, together with the substrate 11, by a diamond cutting disc to form a groove 11*a* in the substrate 11, the groove having a width equal to about 0.2 mm. Alternatively, only the glaze layer 12 may be cut to expose the surface of the substrate 11 or not to expose the same, without cutting the substrate 11.

The process then proceeds to a heat treating step shown in FIG. 1(*c*) wherein the glaze layer 12 is heated at a temperature equal to or higher than its softening point, for example, at about 850° C. for about ten minutes. This heat treatment causes the upper cut edge 201 of the glaze layer 12 to have a radius of curvature equal to about 10 microns. The rounded edge of the glaze layer 12 is preferably formed by the above heat treatment, but may be formed by any other suitable machining or abrading operation.

On termination of the heat treating step, a resistance layer 13 is then formed over the substrate 1 and glaze layer 12, as shown in FIG. 1(*d*) on the left side thereof. An individual lead electrode 14 is then formed over the resistance layer 13 by means of printing and etching techniques. At the same time, a common electrode 15 is formed on the upper portion of the resistance layer 13 in the same manner, spaced away from the individual lead electrode 14 toward the groove 11*a*. The entire surface of the thermal head is finally covered with a protective film 16 to complete a printing portion 101 on the top of the thermal head for each dot.

Since the upper cut edge 201 of the glaze layer 12 is rounded into a given radius of curvature, the protective film 16 will be also formed to have a radius of curvature 202 as shown.

After the protective film 16 has been formed, the process proceeds to a second cutting step shown in FIG. 1(*e*). In the second cutting step, the substrate 11 is cut, together with the protective film 16, by the diamond cutting disc. Since the protective film 16 is adhered directly to the substrate 11 of alumina ceramic having its roughed surface, the adhesion between the substrate 11 and the protective film 16 is strengthened so no chipping occurs as a result of the cutting impact.

Figure 2:
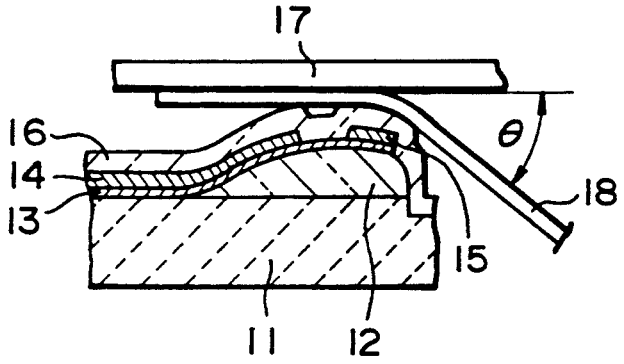
FIG. 2 is a fragmentary cross-sectional view of the thermal head shown in FIG. 1 when it is used together with a thermal transfer ribbon.
Figure 6A:
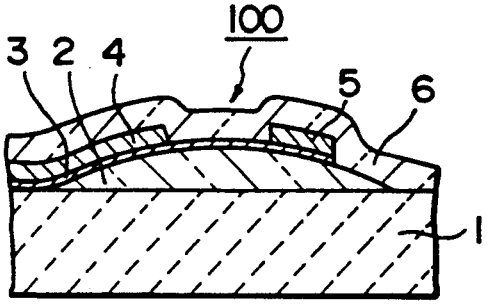
FIG. 6a PRIOR ART
FIG. 6 is a cross-sectional view of the thermal head shown in FIG. 5, illustrating various working steps in accordance with the prior art.
Figure 6B:
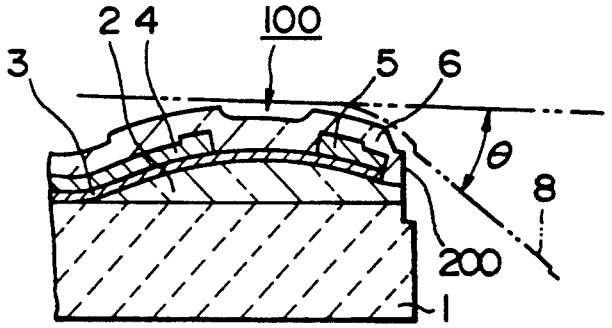
FIG. 6b PRIOR ART
Figure 6C:
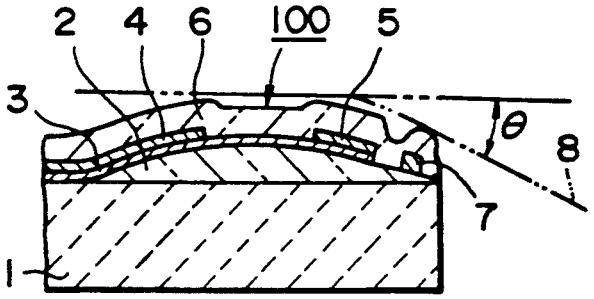
FIG. 6c PRIOR ART

Referring now to FIG. 2, there is shown the thermal head produced by such a process as shown in FIG. 1, which is placed in contact with a thermal transfer ribbon 18. Since the present invention eliminates the need for any means for preventing the chipping, such as the braking and protecting layer 7 (see FIG. 6) or the like, an angle $\theta$ by which the thermal transfer ribbon 18 is separated from a recording sheet 17 can be increased, as shown in FIG. 2.

Modern printing devices are required to print clear letters even if a recording sheet used has a rough surface. The thermal transfer ink has some degree of viscosity so that it can be thermally adhered to the recording sheet, such as a sheet of transfer paper. On the other hand, the thermal transfer ribbon must be rapidly separated from the transfer sheet immediately after the thermal transfer printing has been carried out, such that the printed ink can be prevented from returning from the transfer sheet to the thermal transfer ribbon since the thermal print ink is more easily adhered to the thermal transfer ribbon. In brief, the process requires two steps, that is, one step of rapidly separating the ink from the thermal transfer ribbon 18 when the printing portion 101 of the thermal head is heated and another step of separating the thermal transfer ribbon 18 from the transfer sheet 17 immediately after the thermal transfer printing has been made.

In accordance with the present invention, the thermal transfer ribbon 18 can be rapidly separated from the transfer sheet 17 immediately after the thermal transfer printing has been performed, since the aforementioned angle of separation $\theta$ is increased. From combination of the increased angle of separation $\theta$ with the upper rounded edge 202 of the protective film 16, a distance between a position at which the thermal transfer ribbon 18 is separated from the transfer sheet 17 and the end of the printing portion 101 adjacent to the upper rounded edge 202 of the protective film 16, which will be called simply "separation distance", will approach to zero. Therefore, the heating of the printing portion 101 will not deviate from the time at which the ink is separated from the thermal transfer ribbon 18. As a result, the ink can be properly transferred from the thermal transfer ribbon 18 to the transfer sheet 17 at all times. In such a manner, the thermal head of the present invention can perform the printing operation clearly.

Although the aforementioned embodiment has been described as to the upper edge of the glaze layer 12 rounded by heating, the process may proceed directly to the head shaping step shown in FIG. 1(*d*) without any heating step. Even in such a case, the upper edge 202 of the protective film 16 can be more or less rounded to provide some degree of effectiveness since the protective film 16 is formed after the cutting of the glaze layer 12.

Figure 3:
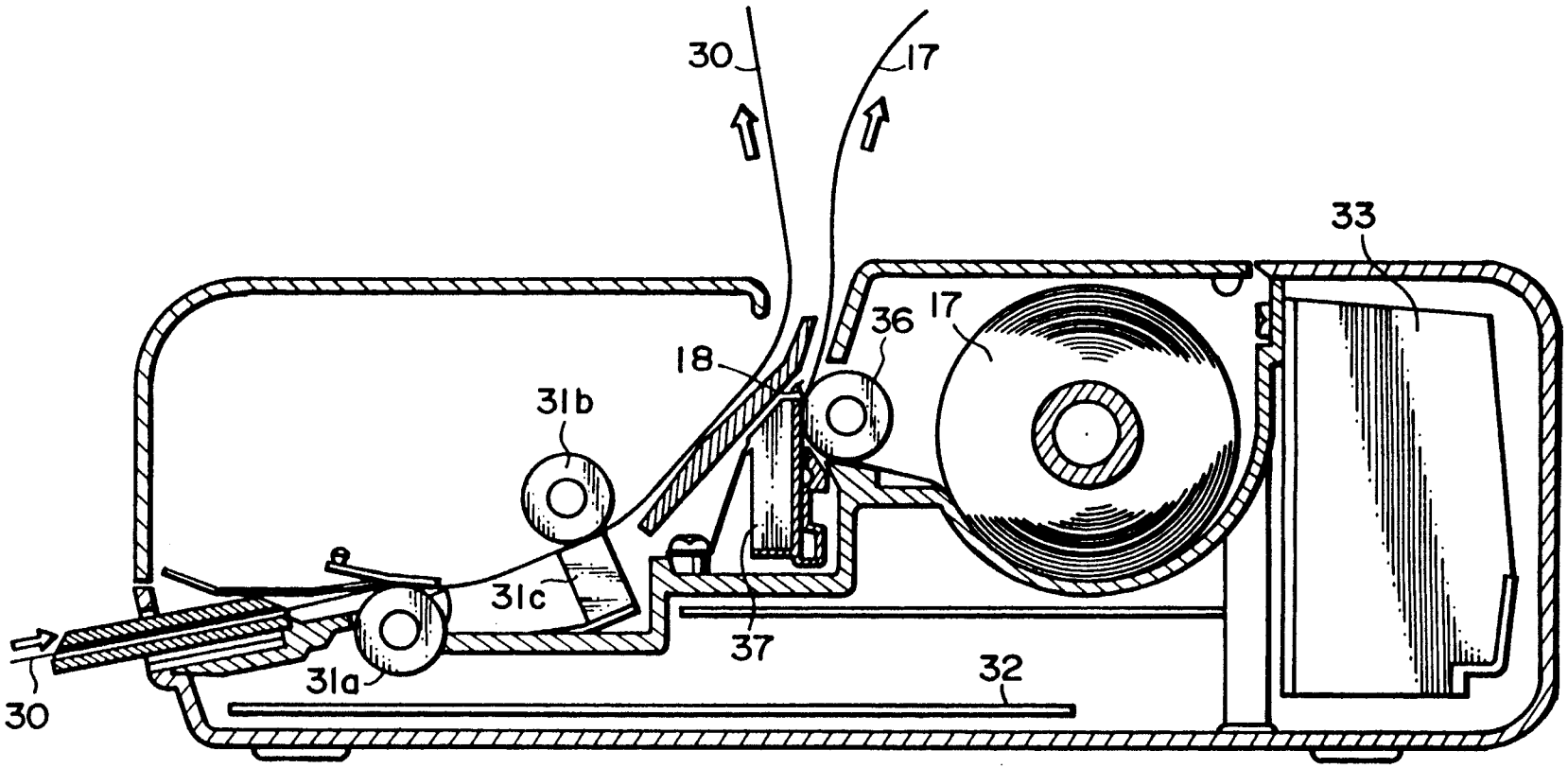
FIG. 3 is a cross-sectional view of a printer in which the thermal head of the present invention is used.

FIG. 3 shows the internal structure of a printer in which the thermal head of the present invention is used. The printer comprises an original supply section, a recording sheet supply section, a thermal transfer printing section, a system control substrate 32 and a source of power 33.

The original supply section comprises feed and platen rollers 31*a* and 31*b* both for feeding an original 30, and an image sensor 31*c*. The recording sheet supply section includes a recording platen roller 36 for feeding a recording sheet 17. These functions are not part of the present invention and so will not be described in detail.

The recording sheet 17 fed from the recording sheet supply section is then subjected to the thermal transfer at the thermal head 37 in the thermal transfer printing section. This will now be described in detail with reference to FIG. 4.

Referring to FIG. 4, the thermal head 37 comprises a rubber platen 38, a heating projection 39 energized through the lead 40 and substrate 11, and a thermal transfer ribbon 18. The recording sheet 17 fed by the recording platen roller 36, having a rough surface, is sandwiched, together with the thermal transfer ribbon 18 incorporated into the thermal head 37, between the rubber platen 38 and the heating projection 39 under the optimum pressure. As a result, the rough surface of the recording sheet 17 will be smoothed so that the ink can be thermally transferred more easily onto the smoothed surface of the recording sheet 17 under the heating action of the heating projection 39. Furthermore, the thermal transfer ribbon 18 can be rapidly separated from the recording sheet 17 without return of the printed ink to the thermal transfer ribbon 18 since the angle of separation $\theta$ is increased in accordance with the present invention. Consequently, the printer in which the thermal head of the present invention is used can print very clearly.

Since the entire edge of the glaze layer is cut and the protective film 16 is formed directly over the cut glaze layer edge and the substrate, in accordance with the present invention, the protective film will be formed on the relatively rough surface of the substrate to greatly improve the adhesion between the protective film and the substrate.

Figure 4A:
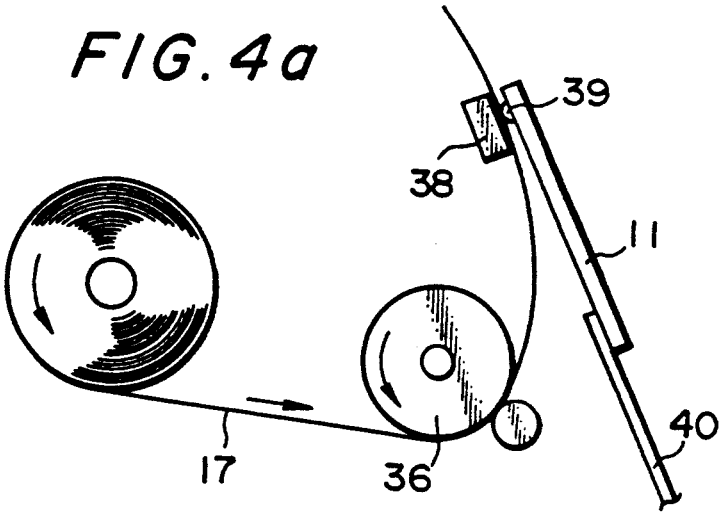
FIG. 4 is a view illustrating the thermal transfer of a recording sheet from the thermal head of the present invention.
Figure 4B:
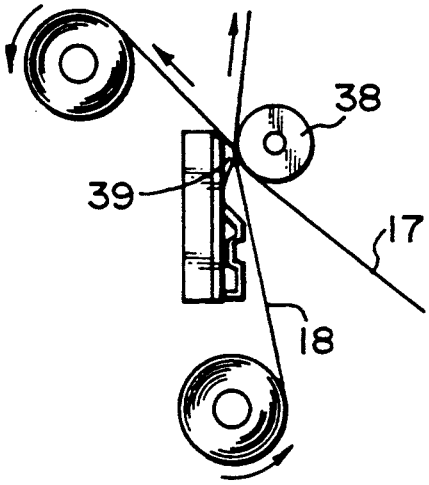

FIG. 4*b* shows the method of FIG. 4*a* which is applied to such a reading device as is used in copying machines, facsimiles and the like. Thus, the rubber platen 38 is of a roller-shaped configuration. However, the thermal head of the present invention may be similarly applied to a printer having no reading device.

Figure 4C:
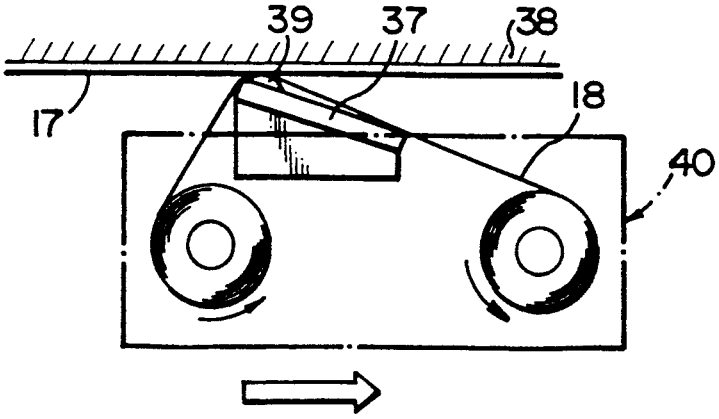
Figure 5:
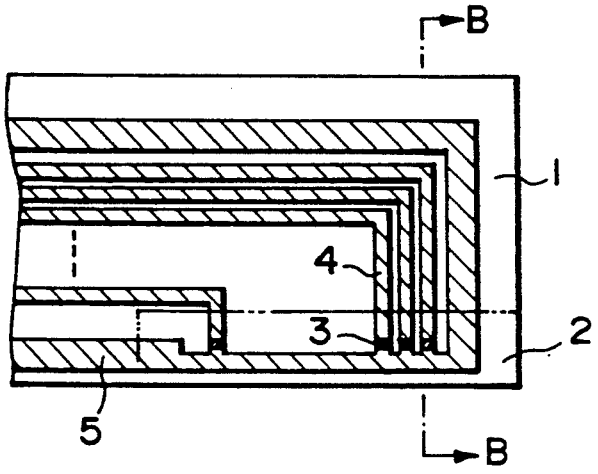
FIG. 5 PRIOR ART
FIG. 5 is a top plan view of a thermal head constructed in accordance with the prior art.

In addition to such a printer in which the thermal head 37 as shown in FIG. 4*a* is fixedly mounted to feed the recording sheet 17 by means of the recording platen roller 36, the present invention may be similarly applied to a serial printer in which the thermal head 37 and ribbon cassette 40 are moved on the recording sheet 17 as shown in FIG. 4*c* and wherein the ink on the ribbon 18 is thermally transferred to the recording sheet 17 by cooperation of the plate-like rubber platen 38 with the heating projection 39 of the thermal head.

In accordance with the method of the present invention, moreover, the glaze layer is cut at a stage when the protective film is still not formed over the glaze layer. This eliminates any chipping between the glaze layer and the protective film to improve the adhesion therebetween and also to improve the adhesion between the protective film and the substrate as described above.

The improvement of the adhesion between the glaze layer and the protective film and between the protective film and the substrate removes the need for any means to prevent chipping, such as the braking and protecting layer of the prior art. This increases the angle of separation of the thermal transfer ribbon from the recording sheet and so improves the print quality.

Since the protective film is formed after the glaze layer has been formed, the upper edge of the thermal head can be slightly rounded without any abrading operation. This eliminates the separation of the ink from the thermal transfer ribbon and the darkened background of the heat-sensitive sheet.

Since the upper edge of the glaze layer is cut and rounded preferably by the heat treatment, the separation of the ink from the thermal transfer ribbon and the darkened background of the heat-sensitive sheet can be overcome more effectively.

I claim:

1. A thermal printing head comprising:

(a) a glaze layer formed, as a heat accumulating layer, on a substrate, an edge of said glaze layer being cut and rounded;

(b) a resistance layer formed on said glaze layer;

(c) electrode layers formed on said resistance layer at a given location;

(d) a printing portion sandwiched between said electrode layers on said glaze layer and not covered with said resistance layer;

(e) a protective film formed on said resistance and electrode layers to cover said glaze, resistance and electrode layers and said printing portion; and (f) anti-separation means for preventing separation of said protective film from a surface of said thermal head, said anti-separation means including:

(i) a portion of said substrate externally exposed by cutting said glaze layer; and (ii) a protective film covering said exposed substrate portion.

2. A thermal printing head as defined in claim 1 wherein said glaze layer includes an upper rounded edge.

3. A thermal printing head as defined in claim 2 wherein the upper rounded edge of said glaze layer has a radius of curvature equal to about 10 microns.

4. A thermal printing head as defined in claim 3 wherein said substrate is made of alumina ceramic which is a dielectric material and wherein said glaze layer is made of $SiO_2$.

5. A thermal printing head as defined in claim 4 wherein said anti-separation means includes a groove formed in the thermal printing head, said groove having a width equal to about 0.2 mm.

6. A method of making a thermal head, comprising:

(a) a glaze layer forming step of forming a glaze layer as a heat accumulating layer on a substrate;

(b) a first cutting step of cutting an edge of the glaze layer to expose a portion of said substrate after said glaze layer has been formed;

(c) a step of forming a resistance layer on said glaze layer and forming electrode layers on said resistance layer for supplying an electric energy to said resistance layer after said first cutting step;

(d) a protective film forming step of forming a protective film over an entire surface of the thermal head after said electrode layers have been formed; and (e) a second cutting step of forming an anti-separation means by cutting said protective film at a position in which said protective film is attached directly to the exposed portion of said substrate at a location adjacent to an upper rounded edge of said glaze layer, after said protective film has been formed.

7. A method as defined in claim 6, further comprising a heat treating step between said first cutting step and said step of forming a resistance layer and electrode layers, said heat treating step being used to round an upper cut edge of said glaze layer by heating said glaze layer.

8. A method as defined in claim 7 wherein said heat treating step is carried out at a temperature of about 850° C. for ten minutes.

9. A printer comprising:

an original image supply section for supplying an original image to be reproduced;

a recording sheet supply section for supplying a recording sheet on which said original image is reproduced;

a thermal transfer printing section for reproducing said original image on said recording sheet, the thermal transfer printing section having a thermal print head, wherein the thermal print head comprises:

a glaze layer formed, as a heat accumulating layer, on a substrate, an edge of said glaze layer being cut and rounded;

a resistance layer formed on portions of said glaze layer;

electrode layers formed on said resistance layer at a given location;

a printing portion sandwiched between said electrode layers on other portions of said glaze layer uncovered by said resistance layer;

a protective film formed on said resistance and electrode layers to cover said glaze, resistance and electrode layers and said printing portion; and anti-separation means for preventing separation of said protective film from a surface of said thermal print head, said anti-separation means including: a portion of said substrate externally exposed by cutting said glaze layer; and said protective film covering said exposed substrate portion.

10. A printer according to claim 9, wherein said glaze layer includes an upper rounded edge.

* * * * *